US011236967B2

(12) United States Patent
Tai et al.

(10) Patent No.: US 11,236,967 B2
(45) Date of Patent: Feb. 1, 2022

(54) PISTOL FRAME

(71) Applicants: Chen-Hung Tai, New Taipei (TW); Hwa-Nung Lee, New Taipei (TW); Yo-Lun Chang, New Taipei (TW)

(72) Inventors: Chen-Hung Tai, New Taipei (TW); Hwa-Nung Lee, New Taipei (TW); Yo-Lun Chang, New Taipei (TW)

( * ) Notice: Subject to any disclaimer, the term of this patent is extended or adjusted under 35 U.S.C. 154(b) by 10 days.

(21) Appl. No.: 17/026,660

(22) Filed: Sep. 21, 2020

(65) Prior Publication Data

US 2021/0116208 A1 Apr. 22, 2021

(30) Foreign Application Priority Data

Oct. 17, 2019 (TW) ..... 108137482

(51) Int. Cl.

| | |
|---|---|
| ***F41A 19/10*** | (2006.01) |
| ***F41C 23/10*** | (2006.01) |
| ***F41C 3/00*** | (2006.01) |
| ***F41C 23/18*** | (2006.01) |
| ***F41A 3/66*** | (2006.01) |

(52) U.S. Cl.

CPC ..... *F41C 3/00* (2013.01); *F41A 3/66* (2013.01); *F41A 19/10* (2013.01); *F41C 23/10* (2013.01); *F41C 23/18* (2013.01)

(58) Field of Classification Search

CPC ..... F41A 19/10; F41A 19/12; F41A 19/15; F41A 19/06; F41A 19/11

See application file for complete search history.

(56) References Cited

U.S. PATENT DOCUMENTS

| | | | | |
|---|---|---|---|---|
| 10,845,156 | B1 * | 11/2020 | Fortin | F41A 3/66 |
| 2014/0317981 | A1 * | 10/2014 | O'Clair | F41A 3/12 42/14 |
| 2017/0350665 | A1 * | 12/2017 | Borges | F41A 19/11 |
| 2018/0328681 | A1 * | 11/2018 | Borges | F41A 3/64 |
| 2019/0024996 | A1 * | 1/2019 | Borges | F41A 3/64 |
| 2020/0056853 | A1 * | 2/2020 | Singh | F41A 19/12 |
| 2020/0217604 | A1 * | 7/2020 | Borges | F41C 23/10 |
| 2021/0199399 | A1 * | 7/2021 | Wolf | F41A 11/02 |
| 2021/0222980 | A1 * | 7/2021 | O'Clair | F41A 19/31 |

* cited by examiner

*Primary Examiner* — Derrick R Morgan

(74) *Attorney, Agent, or Firm* — Birch, Stewart, Kolasch & Birch, LLP

(57) ABSTRACT

A pistol frame is suitable for mounting of a trigger mechanism which includes a trigger mechanism housing having a through channel. The pistol frame includes an upper frame portion defining a rear receiving space, and a rear rail block disposed in the rear receiving space and including a bottom plate, and two side plates extending upwardly the bottom plate. Each side plate has a through hole suitable for aligning with the through channel to permit extension of a trigger housing pin therethrough to thereby fix the rear rail block and the trigger mechanism housing to the upper frame portion. The bottom plate and the side plates cooperatively define at least one receiving space suitable for receiving the extensions.

6 Claims, 17 Drawing Sheets

PISTOL FRAME

CROSS-REFERENCE TO RELATED APPLICATION

This application claims priority to Taiwanese Patent Application No. 108137482, filed on Oct. 17, 2019.

FIELD

The disclosure relates to a pistol frame.

BACKGROUND

Due to the fact that a pistol has few components and a simple structure, and is durable and reliable, it is often used as a gun for a police or a toy gun for a survival game. Its appearance and interior structure are constantly updated to satisfy the use requirements of different units, the experience of using the gun and the desire of collection of consumers. After using the pistol for a certain number of years, only the frame must be replaced, and the inner components, such as the locking block, the trigger, etc., made by the original manufacturer may still be usable. Thus, some manufacturers will only make plastic frames for the pistols, and the user can remove the inner components from the pistol made by the original manufacturer and install them into the new plastic frame to produce a new pistol with plastic frame.

The trigger must rely on a trigger mechanism housing for it to be disposed on the plastic frame of the pistol. Since the triggers of different generations of Glock pistols have different structures, the existing trigger mechanism housing cannot be commonly used. Moreover, after a bullet is fired from the pistol, the slide of the pistol will move rearward and eject the spent shell. Since a strong reaction force is generated at the muzzle of the pistol the moment a bullet is fired, a front end of the slide is lifted up slightly, and a torque is generated on the locking block, so that the existing locking block may be damaged due to the lifting of the slide.

SUMMARY

Therefore, an object of the present disclosure is to provide a pistol frame that is capable of alleviating at least one of the drawbacks of the prior art.

Accordingly, a pistol frame of this disclosure is suitable for mounting of a trigger mechanism, a slide and a barrel thereto. The trigger mechanism includes a trigger mechanism housing having two legs, two extensions extending downwardly and respectively from bottom front ends of the legs, and a through channel extending through the trigger mechanism housing in a left-right direction. The pistol frame includes an upper frame portion, a handgrip portion and a rear rail block. The upper frame portion extends along a front-rear direction transverse to the left-right direction, and is suitable for mounting of the slide and the barrel thereto. The upper frame portion includes a rear section that defines a rear receiving space. The handgrip portion is connected to and extends downwardly from the upper frame portion. The rear rail block is disposed in the rear receiving space, and is suitable for receiving and supporting the trigger mechanism housing. The rear rail block includes a bottom plate, two side plates extending upwardly and respectively from left and right ends of the bottom plate and configured to be located at two lateral sides of the trigger mechanism housing, and two rear rail portions extending transversely, outwardly, oppositely and respectively from top ends of the side plates for forward and rearward sliding movement of the slide thereon. Each side plate has a through hole. The through holes in the side plates are configured to align with the through channel for extension of a trigger housing pin therethrough, thereby fixing the rear rail block and the trigger mechanism housing to the upper frame portion. The bottom plate and the side plates cooperatively define at least one receiving space suitable for receiving the extensions.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
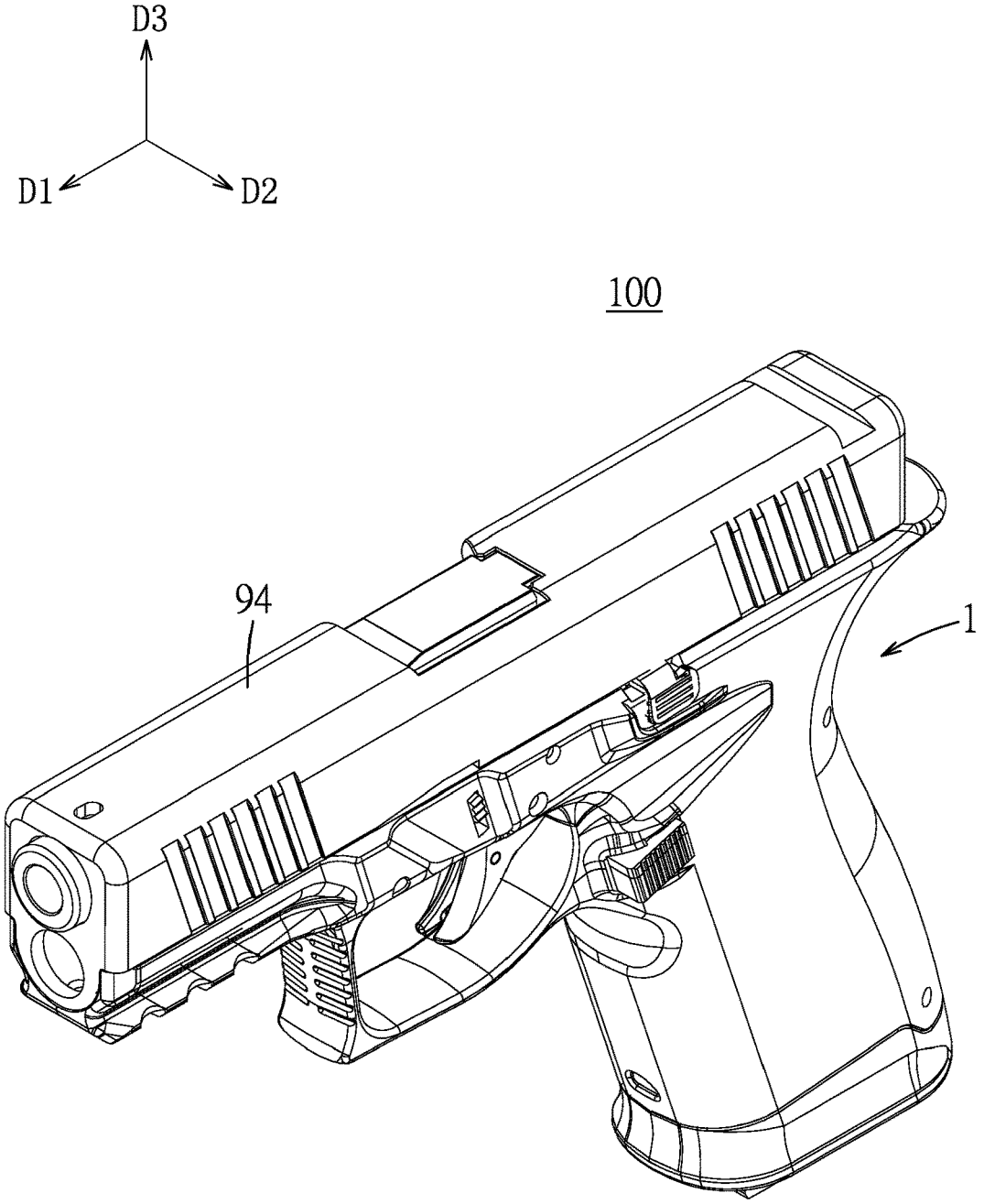
FIG. 1 is a perspective view of a pistol incorporating a pistol frame according to the first embodiment of the present disclosure.

Before the present disclosure is described in greater detail, it should be noted herein that like elements are denoted by the same reference numerals throughout the disclosure.

Figure 2:
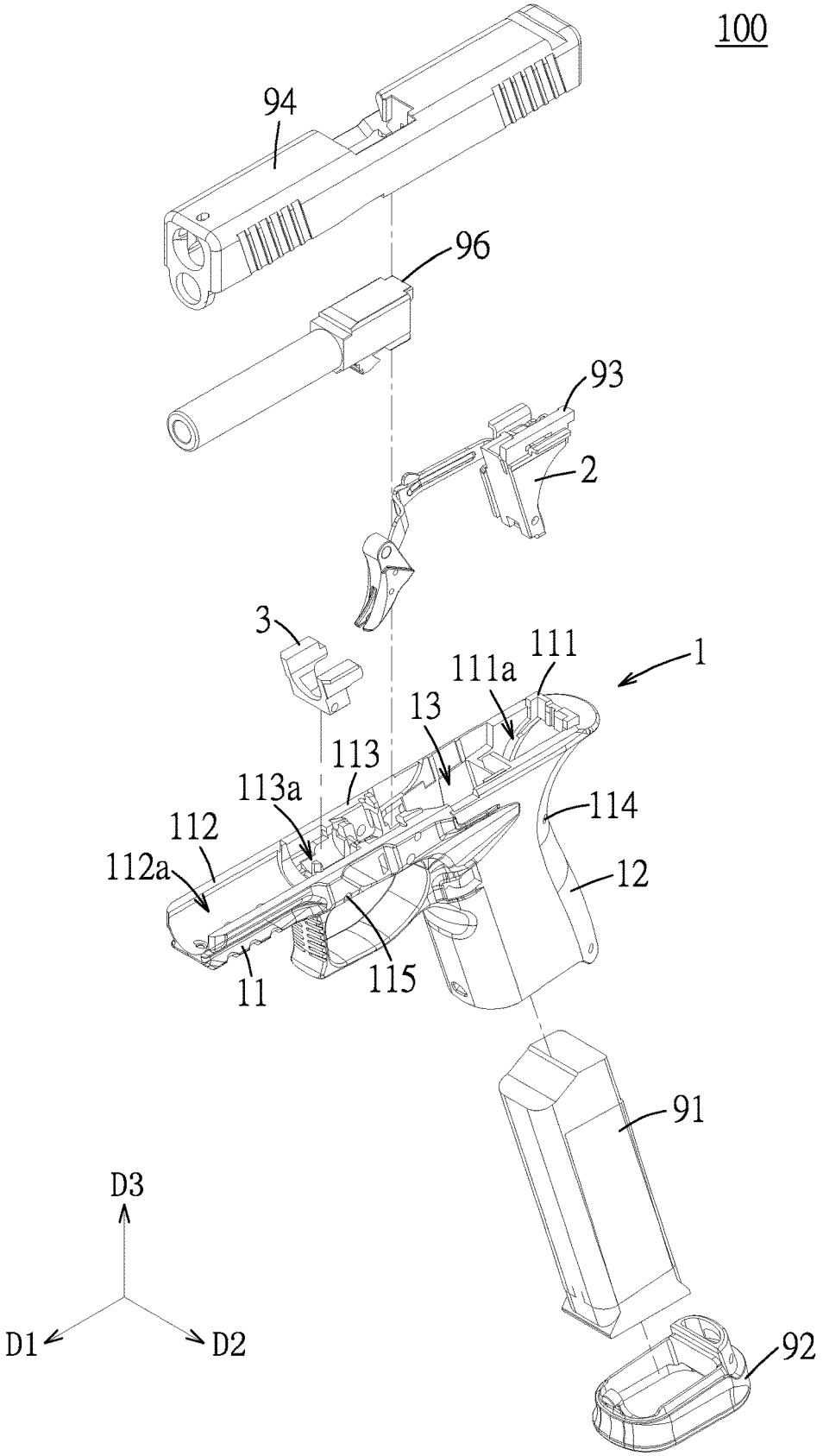
FIG. 2 is an exploded perspective view of FIG. 1.

FIGS. 1 and 2 illustrate a pistol 100 incorporating a pistol frame 1 according to the first embodiment of the present disclosure. The pistol 100 includes the pistol frame 1, and a trigger mechanism 93, a slide 94 and a barrel 96 all mounted on the pistol frame 1. The trigger mechanism 93 is exemplified as a trigger mechanism of a Glock pistol made by an original manufacturer in this embodiment, but is not limited thereto. The trigger mechanism 93 includes a trigger mechanism housing 931 having two legs 932, two extensions 933 extending downwardly and respectively from bottom front ends of the legs 932, a through channel 934 extending through the trigger mechanism housing 931 in a left-right direction (D2), and a concave groove 935 formed between the legs 932. The pistol frame 1 is made of plastic, and includes an upper frame portion 11, a handgrip portion 12, a rear rail block 2, and a locking block 3.

The upper frame portion 11 extends along a front-rear direction (D1) transverse to the left-right direction (D2), and includes a rear section 111, a front section 112, and an intermediate section 113 between the rear and front sections 111, 112. The rear section 111 defines a rear receiving space (111*a*). The front section 112 defines a front receiving space (112*a*) for receiving the barrel 96 and a recoil spring (not shown). The intermediate section 113 defines a mounting space (113*a*). A detailed structure of the intermediate section 113 will be described later.

The handgrip portion 12 is connected to and extends downwardly from the upper frame portion 11, and cooperates with the same to define an accommodation space 13. The accommodation space 13 is located between the rear section 111 and the intermediate section 113 of the upper frame portion 11. A magazine 91 is inserted into the accommodation space 13 from a bottom end of the handgrip portion 12.

A magazine base 92 is disposed on the bottom end of the handgrip portion 12 to position the magazine 91 inside the accommodation space 13. The upper frame portion 11 has two first insertion holes 114 extending through left and right sides of a junction between the handgrip portion 12 and the rear section 111 and communicating with the rear receiving space (111*a*), and two second insertion holes 115 extending through left and right sides of the intermediate section 113 and communicating with the mounting space (113*a*).

Figure 3:
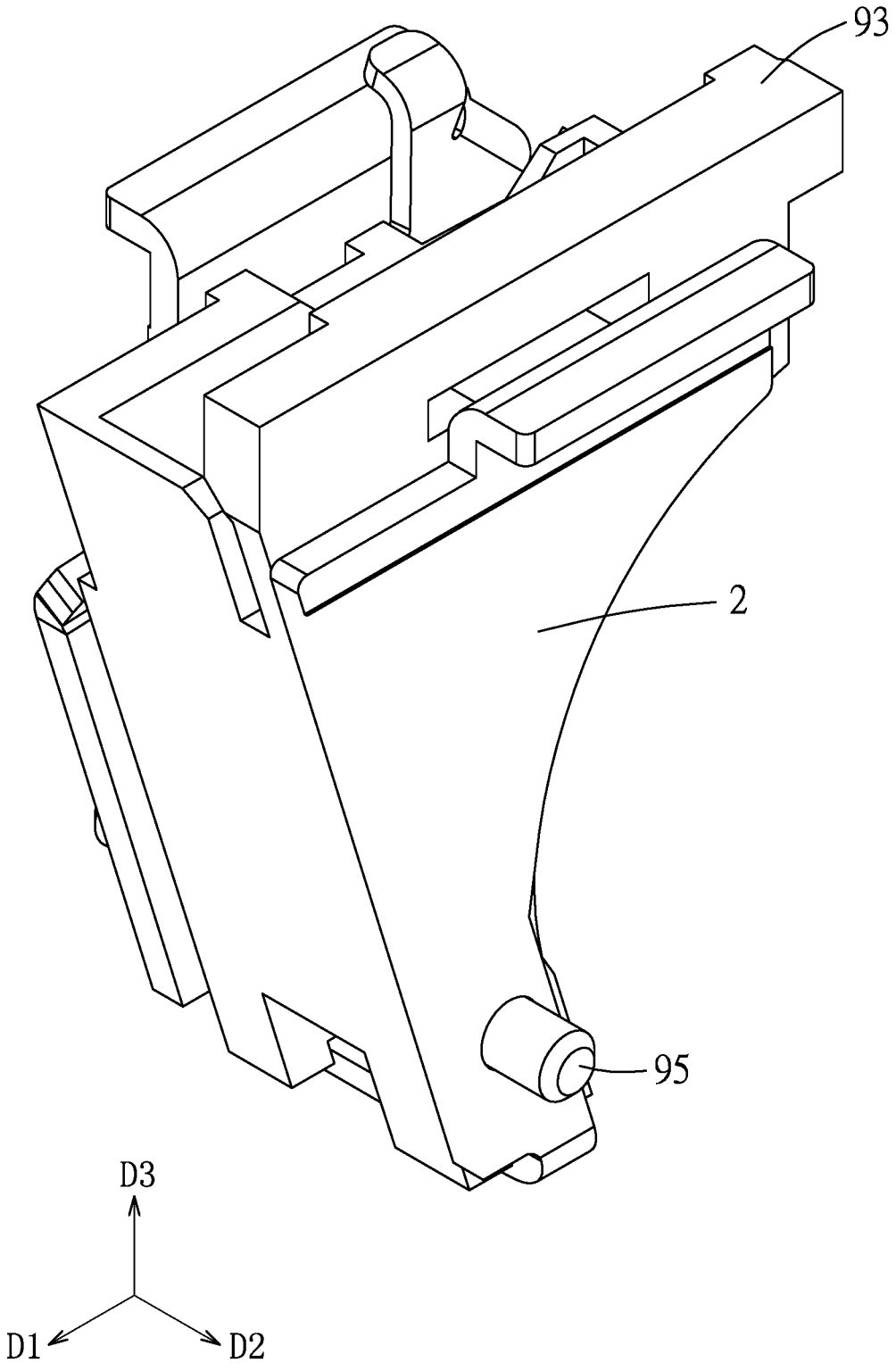
FIG. 3 is a perspective view of an assembly of a rear rail block of the first embodiment and a trigger mechanism housing.
Figure 4:
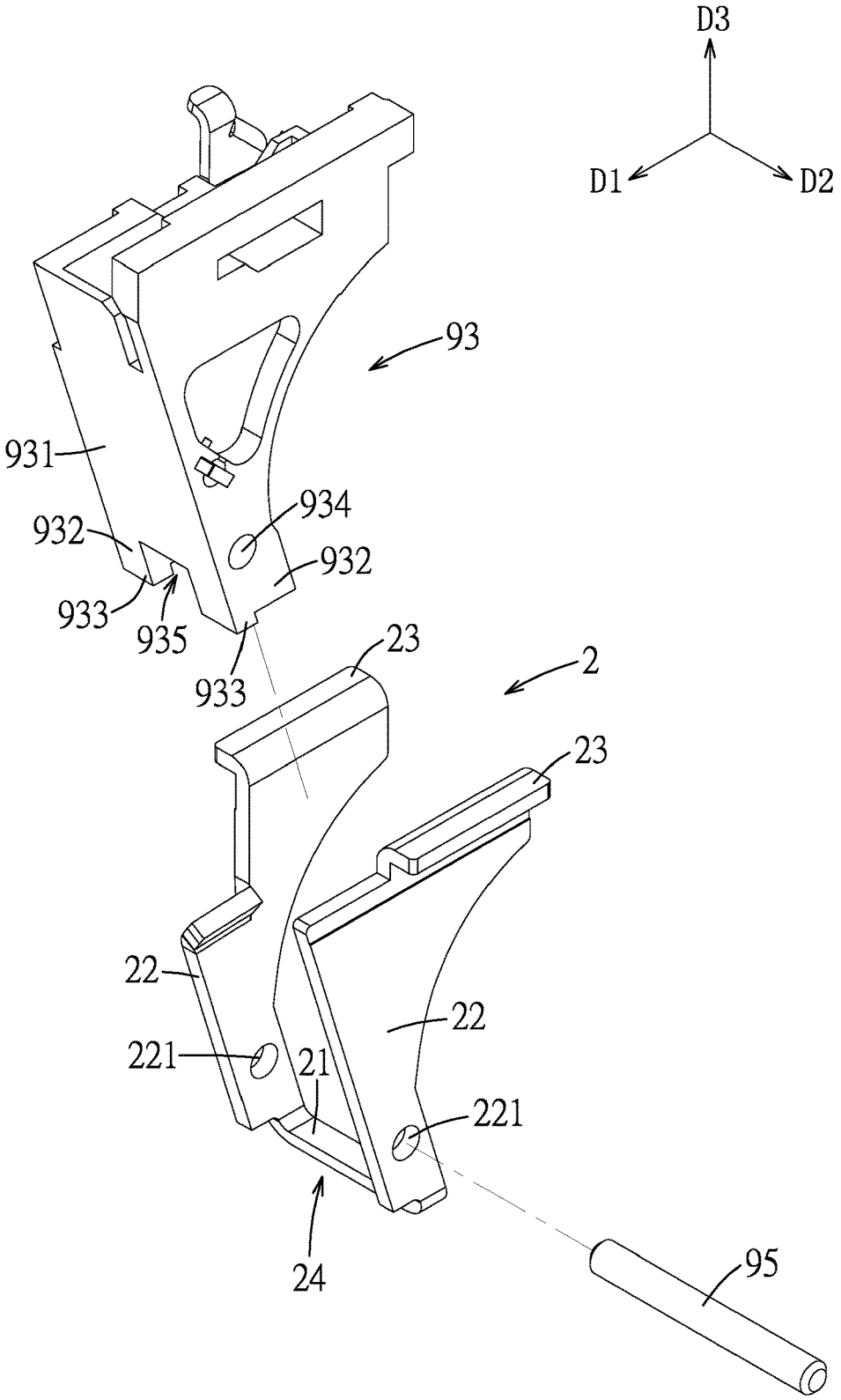
FIG. 4 is an exploded perspective view of FIG. 3.
Figure 5:
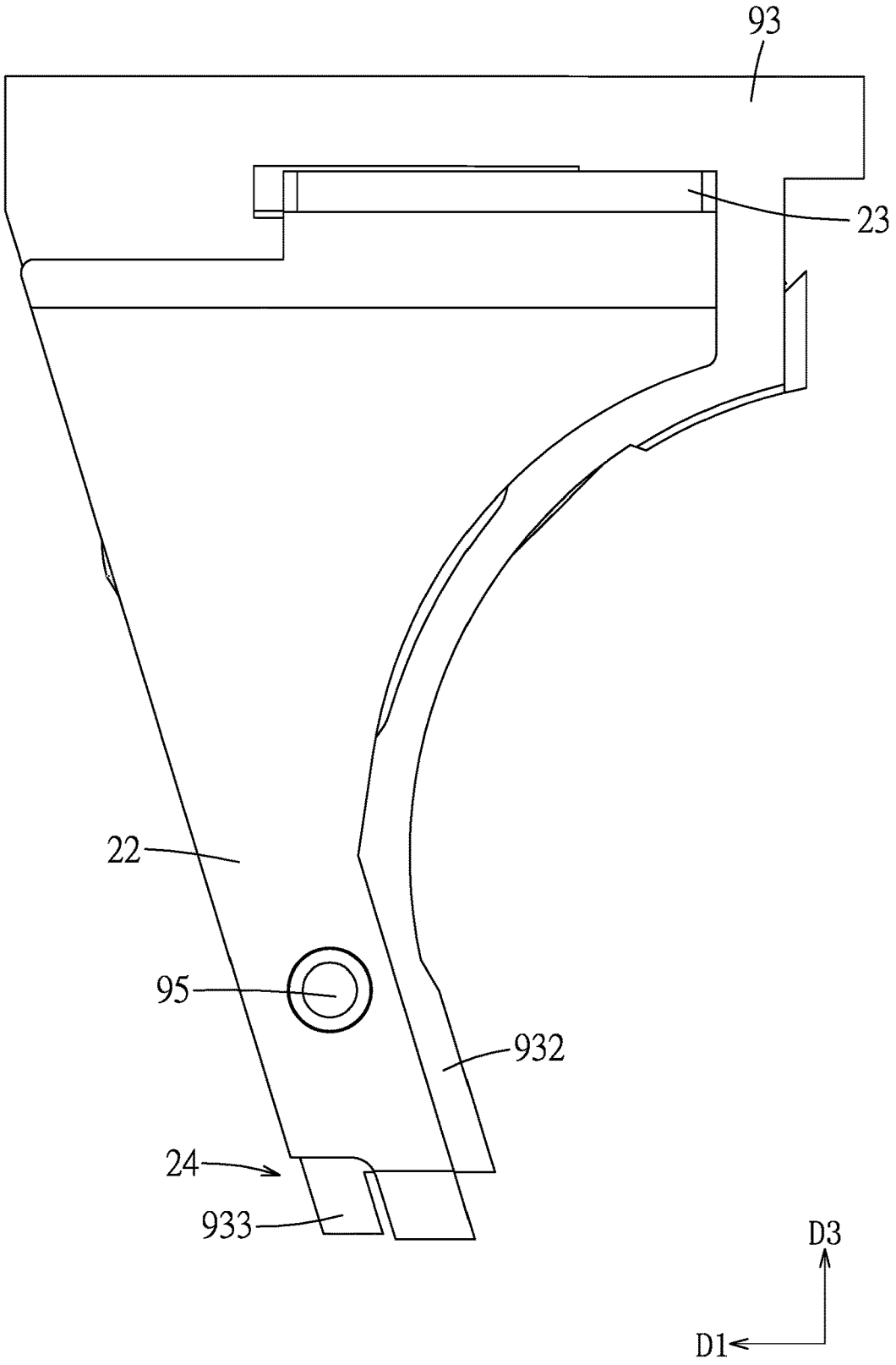
FIG. 5 is a schematic side view of FIG. 3.

Referring to FIGS. 3 to 5, in combination with FIGS. 1 and 2, the rear rail block 2 is suitable for receiving and supporting the trigger mechanism housing 931, and is disposed in the rear receiving space (111*a*) together with the trigger mechanism housing 931. The rear rail block 2 includes a bottom plate 21, two side plates 22, and two rear rail portions 23. The side plates 22 extend upwardly and respectively from left and right ends of the bottom plate 21, and are configured to be located at two lateral sides of the trigger mechanism housing 931. Rear sides of the side plates 22 are flush with a rear side of the bottom plate 21, while front sides of the side plates 22 protrude out of a front side of the bottom plate 21. That is, the front side of the bottom plate 21 is located rearwardly of the front sides of the side plates 22. Each side plate 22 has a through hole 221 proximate to the bottom plate 21. In this embodiment, the bottom plate 21 and the side plates 22 cooperatively define a receiving space 24 extending along the left-right direction (D2) and located at the front side of the bottom plate 21 for receiving the extensions 933 of the trigger mechanism housing 931. The rear rail portions 23 extend transversely, outwardly, oppositely and respectively from top ends of the side plates 22.

When the trigger mechanism housing 931 is disposed on the rear rail block 2, the legs 932 thereof are located above the bottom plate 21, the extensions 933 thereof are received in the receiving space 24, and the through channel 934 thereof is aligned with the through holes 221. When the rear rail block 2 together with the trigger mechanism housing 931 is disposed in the rear receiving space (111*a*), the through channel 934, the through holes 221 and the first insertion holes 114 are aligned with each other along the left-right direction (D2). A trigger housing pin 95 can then be inserted into the through channel 934, the through holes 221 and the first insertion holes 114 so as to fix the rear rail block 2 and the trigger mechanism housing 931 to the upper frame portion 11. In this embodiment, the legs 932 are not in direct contact with the bottom plate 21, but are spaced apart from the bottom plate 21 by a distance along a top-bottom direction (D3) transverse to the front-rear direction (D1) and the left right direction (D2). However, in other implementations, the legs 932 may be directly in contact with the bottom plate 21, so that the bottom plate 21 serves a function of carrying the trigger mechanism housing 931.

Figure 6:
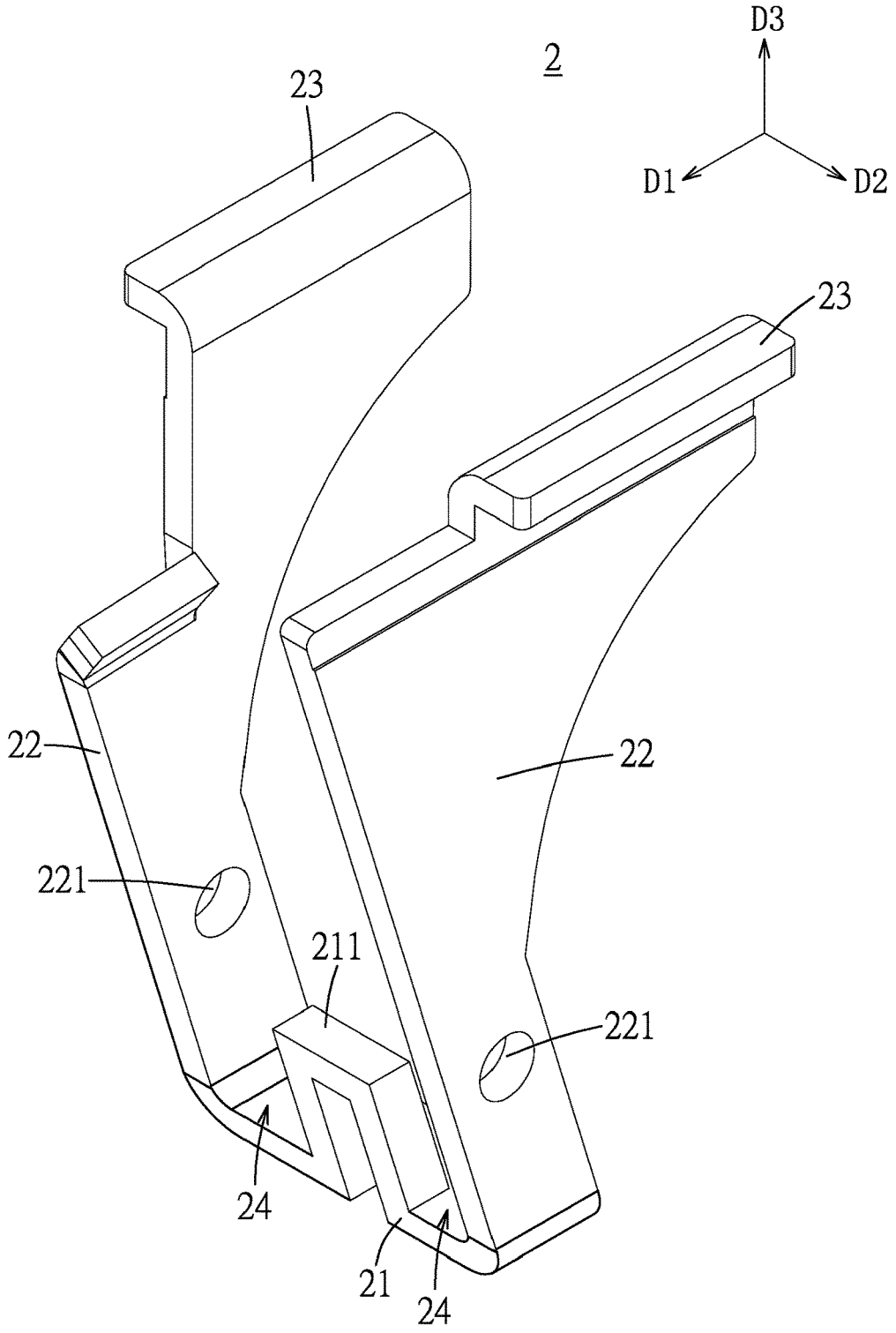
FIG. 6 is an alternative form of the rear rail block of the first embodiment.

FIG. 6 illustrates an alternative form of the rear rail block 2 of the first embodiment. In this case, the front side of the bottom plate 21 is flush with the front sides of the side plates 22, and the bottom plate 21 has a raised section 211 at the center thereof. Further, the bottom plate 21, the side plates 22 and the raised section 211 cooperatively define two receiving spaces 24, each of which is located between one side of the raised section 211 and a corresponding one of the side plates 22. When the trigger mechanism housing 931 is disposed on the rear rail block 2, the raised section 211 is inserted into the concave groove 935 of the trigger mechanism housing 931, while the legs 932 and the extensions 933 of the trigger mechanism housing 931 are received in the receiving spaces 24. The raised section 211 serves to push upward the trigger mechanism housing 931, so that the extensions 933 thereof can either contact or keep a space with the bottom plate 21.

Figure 7:
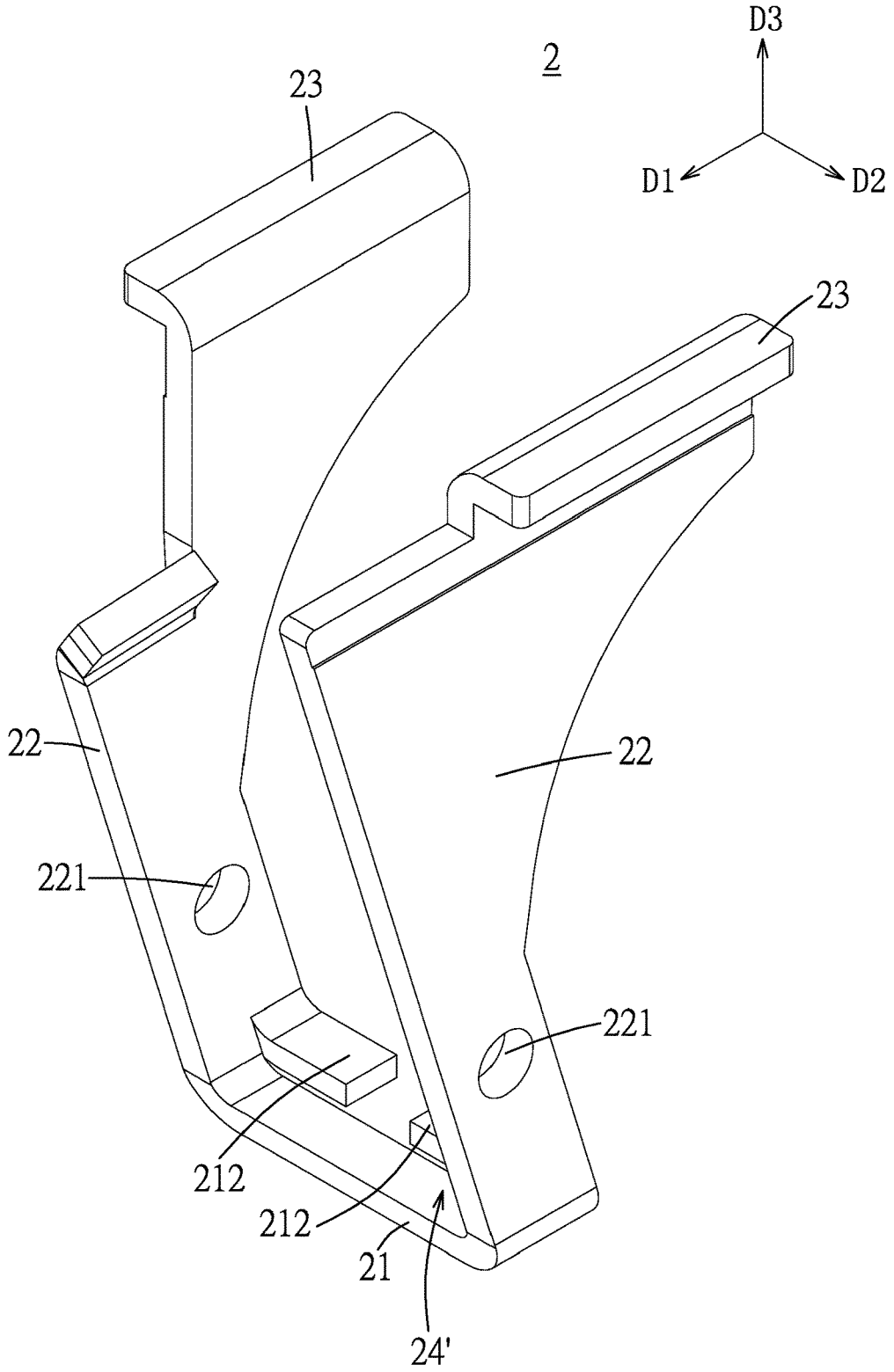
FIG. 7 is another alternative form of the rear rail block of the first embodiment.

FIG. 7 illustrates another alternative form of the rear rail block 2 of the first embodiment. In this case, the bottom plate 21 has a front side flush with the front sides of the side plates 22, and a rear side located rearwardly of the rear sides of the side plates 22. The rear rail block 2 further includes two spaced-apart bottom auxiliary plates 212 respectively connected to inner bottom sides of the side plates 22 and disposed slightly higher than the bottom plate 21. The bottom auxiliary plates 212 have rear sides flush with the rear sides of the side plates 22, and front sides opposite to the rear sides of the bottom auxiliary plates 212. The bottom plate 21 and the side plates 22 cooperatively define a receiving space 24' located forwardly of the bottom auxiliary plates 212 such that the front sides of the bottom auxiliary plates 212 face the receiving space 24'. When the trigger mechanism housing 931 is disposed on the rear rail block 2, the legs 932 thereof are respectively disposed on the bottom auxiliary plates 212, and the extensions 933 thereof are received in the receiving space 24'.

The detailed structures of the intermediate section 113 of the upper frame portion 11 and the locking block 3 will be described below.

Figure 8:
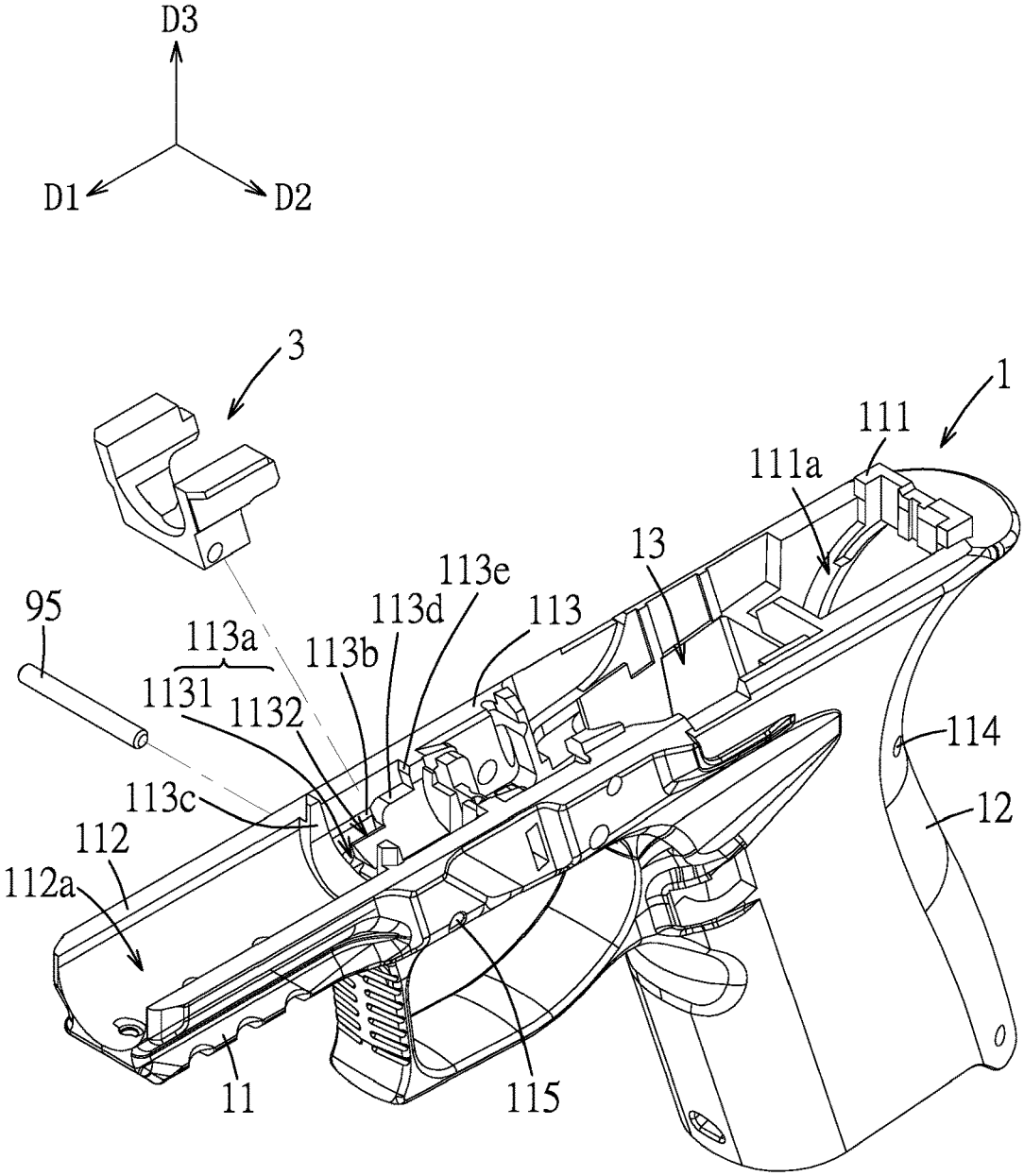
FIG. 8 is a partly exploded perspective view of the first embodiment but without the rear rail block.
Figure 9:
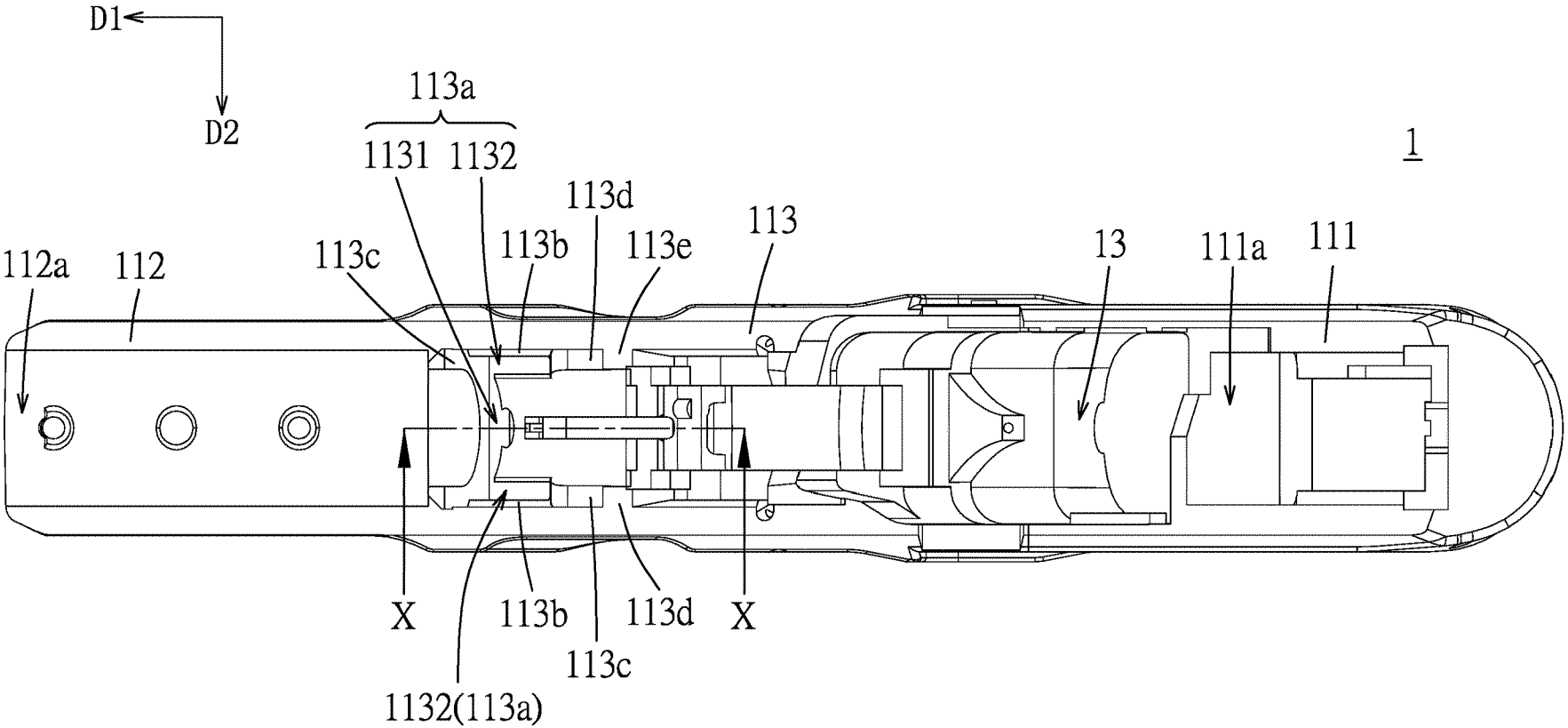
FIG. 9 is a schematic top view of the first embodiment but without the rear rail block and a locking block.

Referring to FIGS. 8 and 9, the mounting space (113*a*) 11 of the intermediate section 113 includes a front space portion 1131, and two side space portions 1132 extending rearwardly and respectively from two opposite ends of the front space portion 1131. Moreover, the intermediate section 113 includes two inner abutment portions (113*b*) respectively located on two opposite sides of the side space portions 1132, a substantially U-shaped front stop portion (113*c*) located in front of the mounting space (113*a*) and connected to front sides of the inner abutment portions (113*b*), two shoulder portions (113*d*) respectively located at the back of the side space portions 1132 and respectively connected to rear sides of the inner abutment portions (113*b*), and two rear stop portions (113*e*) respectively connected to and disposed higher than the shoulder portions (113*d*).

Figure 10:
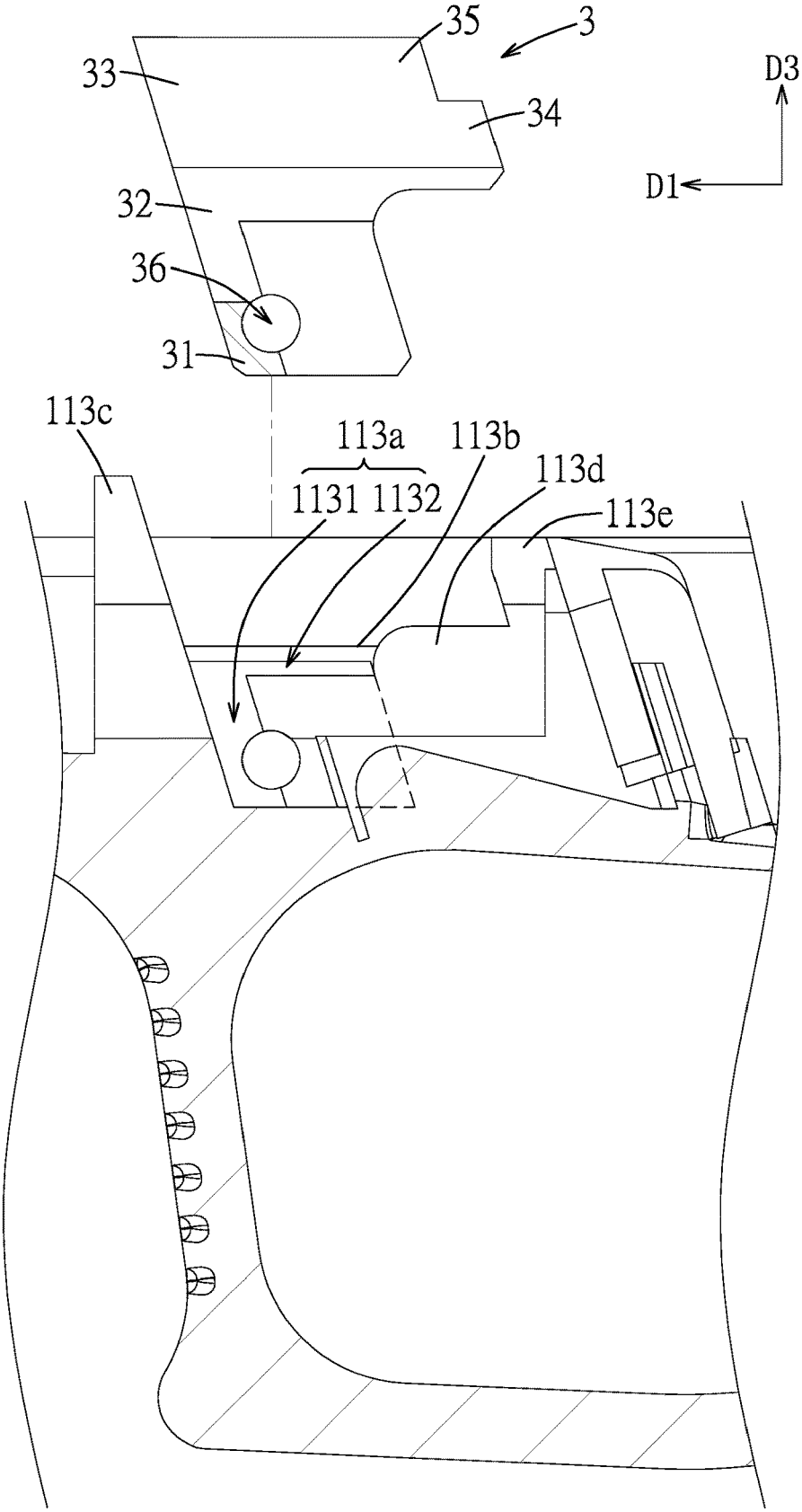
FIG. 10 is a sectional view taken along line X-X of FIG. 9, illustrating how the locking block can be disposed in a mounting space.

Referring to FIG. 10, the front sides of the inner abutment portions (113*b*) and rear sides of the front stop portion (113*c*) are designed to be inclined, so that the front space portion

1131 and the side space portions 1132 extend forwardly and inclinedly relative to the front-rear direction (D1). Front sides of the rear stop portions (113*e*) are also designed to be inclined. The effects of designing the front space portion 1131, the side space portions 1132 and the rear stop portions (113*e*) in inclined manners will be described later.

Figure 11:
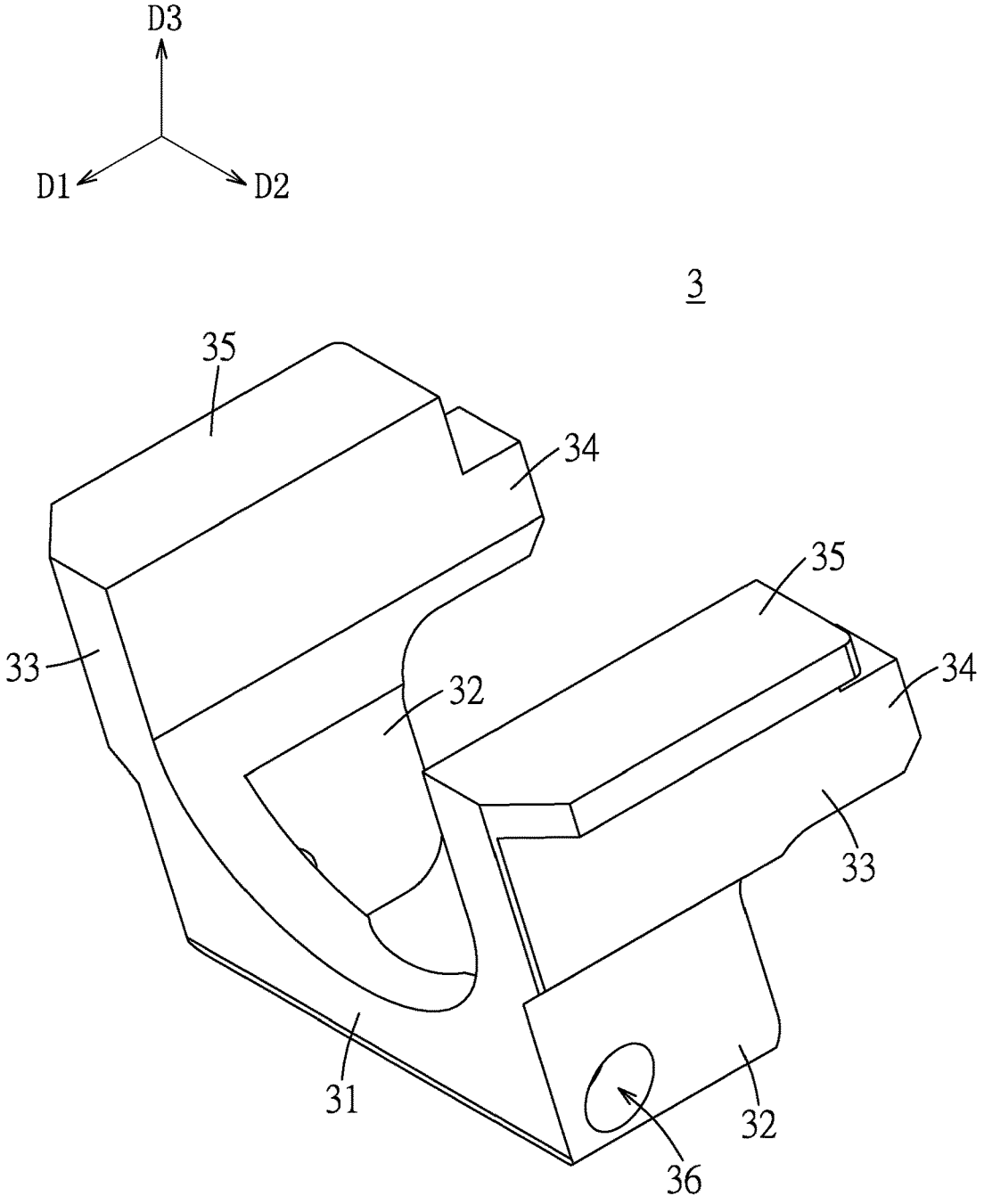
FIG. 11 is a perspective view of the locking block of the first embodiment.
Figure 12:
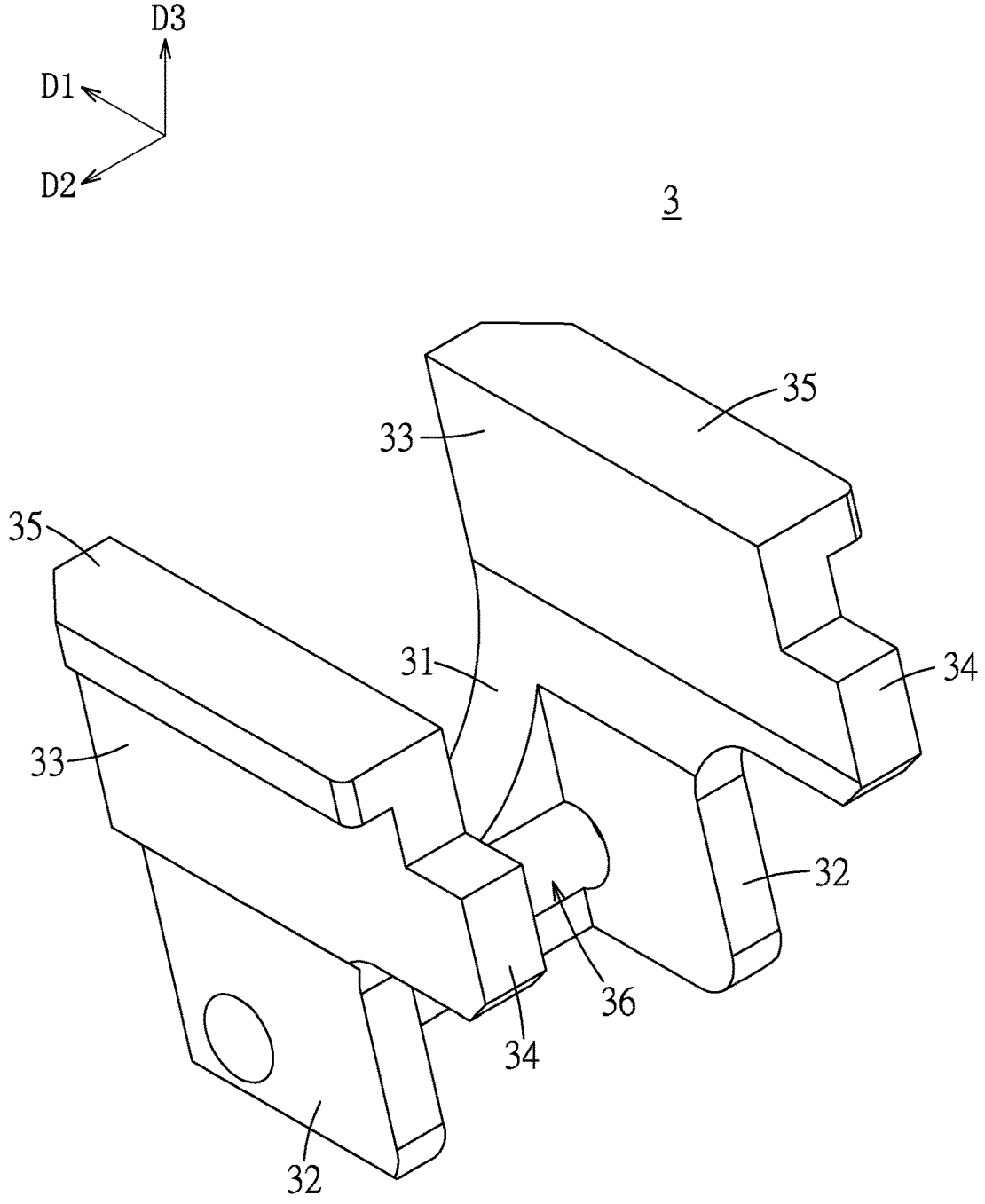
FIG. 12 is a view similar to FIG. 11, but taken from another angle.

Referring to FIGS. 11 and 12, in combination with FIG. 8, the locking block 3 is disposed in the mounting space (113*a*), and includes a front insertion portion 31, two side insertion portions 32, two side connecting portions 33, two rear protruding portions 34, and two front rail portions 35. The side insertion portions 32 extend rearwardly and respectively from two opposite ends of the front insertion portion 31. It should be noted herein that the front insertion portion 31 has a shape matching that of the front space portion 1131, and each side connecting portion 33 has a shape matching that of a respective one of the side space portions 1132, so that the front insertion portion 31 and the side connecting portions 33 are also inclined. The front insertion portion 31 and the side insertion portions 32 cooperatively define a channel 36 extending through the side insertion portions 32 and a rear side of the front insertion portion 31. The side connecting portions 33 are respectively connected to upper ends of the side insertion portions 32, and have outer surfaces respectively protruding out of outer surfaces of the side insertion portions 32. The rear connecting portions 34 protrude rearwardly and respectively from rear ends of the side connecting portions 33. The front rail portions 35 extend transversely, outwardly, oppositely and respectively from top ends of the side connecting portions 33.

Referring again to FIG. 10, when the locking block 3 is disposed in the mounting space (113*a*), the front insertion portion 31 of the locking block 3 is inclinedly inserted into the front space portion 1131; the side insertion portions 32 are inserted inclinedly and respectively into the side space portions 1132; the side connecting portions 33 have the outer surfaces pressingly abutting against the respective inner abutment portions (113*b*), and front ends respectively abutting against the front stop portions (113*c*); the rear protruding portions 34 have bottom ends respectively abutting and pressing against the shoulder portions (113*d*), and front ends respectively abutting against the rear stop portions (113*e*); and the channel 36 is aligned with the second insertion holes 115 for insertion of the trigger housing pin 95 therethrough. Moreover, after the rear rail block 2 and the locking block 3 are mounted to the upper frame portion 11, the slide 94 (see FIGS. 1 and 2) can be mounted to the upper frame portion 11, can be connected to the rear rail block 2 and the locking block 3, and can be operated to move forward and rearward along the front rail portions 35 and the rear rail portions 23.

Generally speaking, the moment a bullet is fired from a pistol, the slide thereof will move rearward to eject the spent shell of the bullet. Since a strong reaction force is generated at the muzzle of the pistol the moment the bullet is fired, a front end of the slide is lifted up slightly, and a torque is generated on the locking block, so that the existing locking block may be damaged due to the lifting of the slide. In this embodiment, because the front insertion portion 31 and the side connecting portions 33 of the locking block 3 are designed to be inclined forwardly, and because the front space portion 1131 and the side space portions 1132 are also designed to be inclined forwardly, when the locking block 3 is driven by the slide 94 to move rearward and upward, the torque generated by the slide 94 to the locking block 3 can make the side connecting portions 33 of the locking block 3 to tightly abut against the front stop portions (113*c*) and the rear protruding portions 34 to tightly abut against the shoulder portions (113*d*) and the rear stop portions (113*e*), so that the locking block 3 is tightly fixed in the mounting space (113*a*) and will not be raised by the slide 94.

Figure 13:
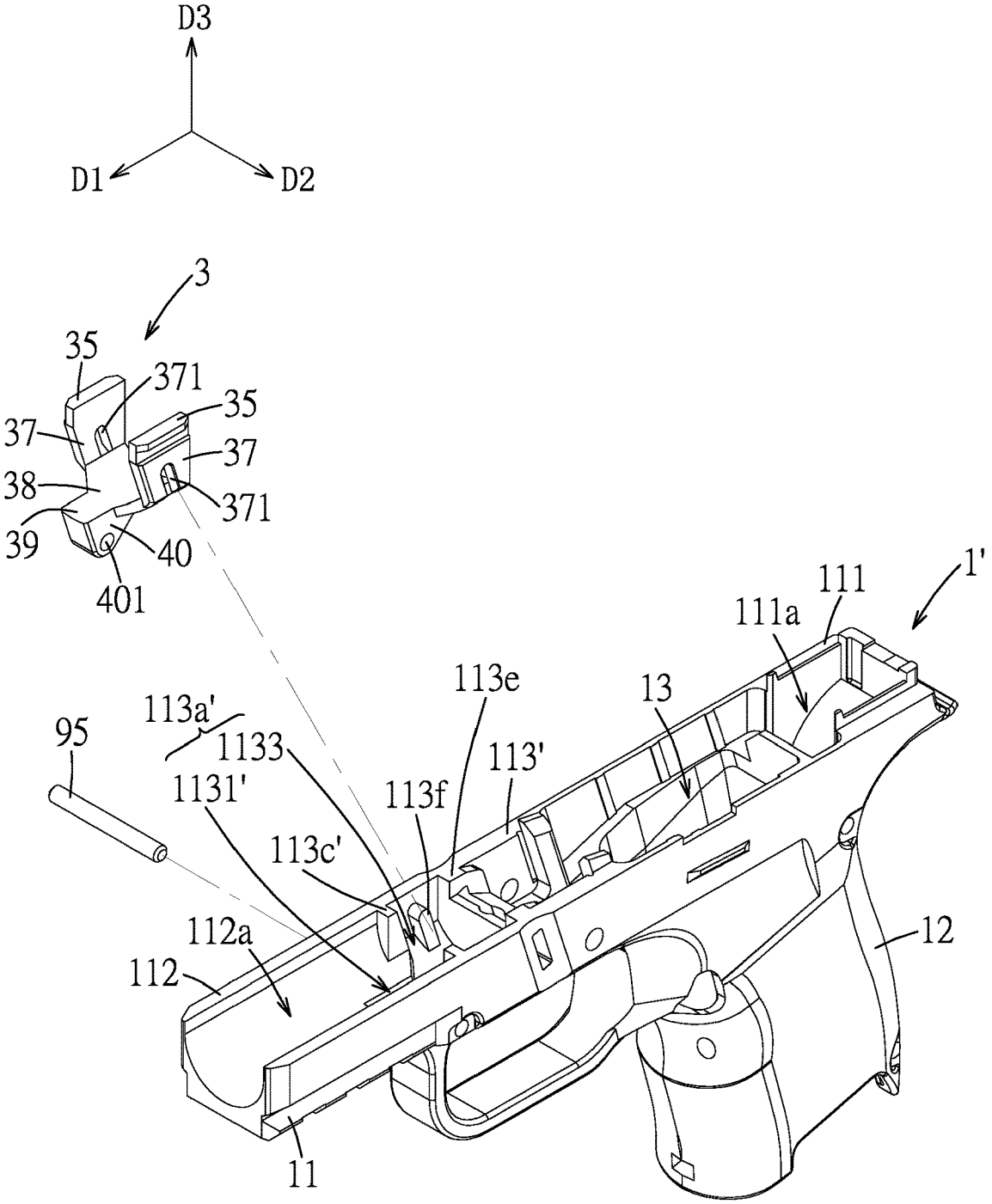
FIG. 13 is a partly exploded perspective view of a pistol frame according to the second embodiment of the present disclosure but without a rear rail block.
Figure 14:
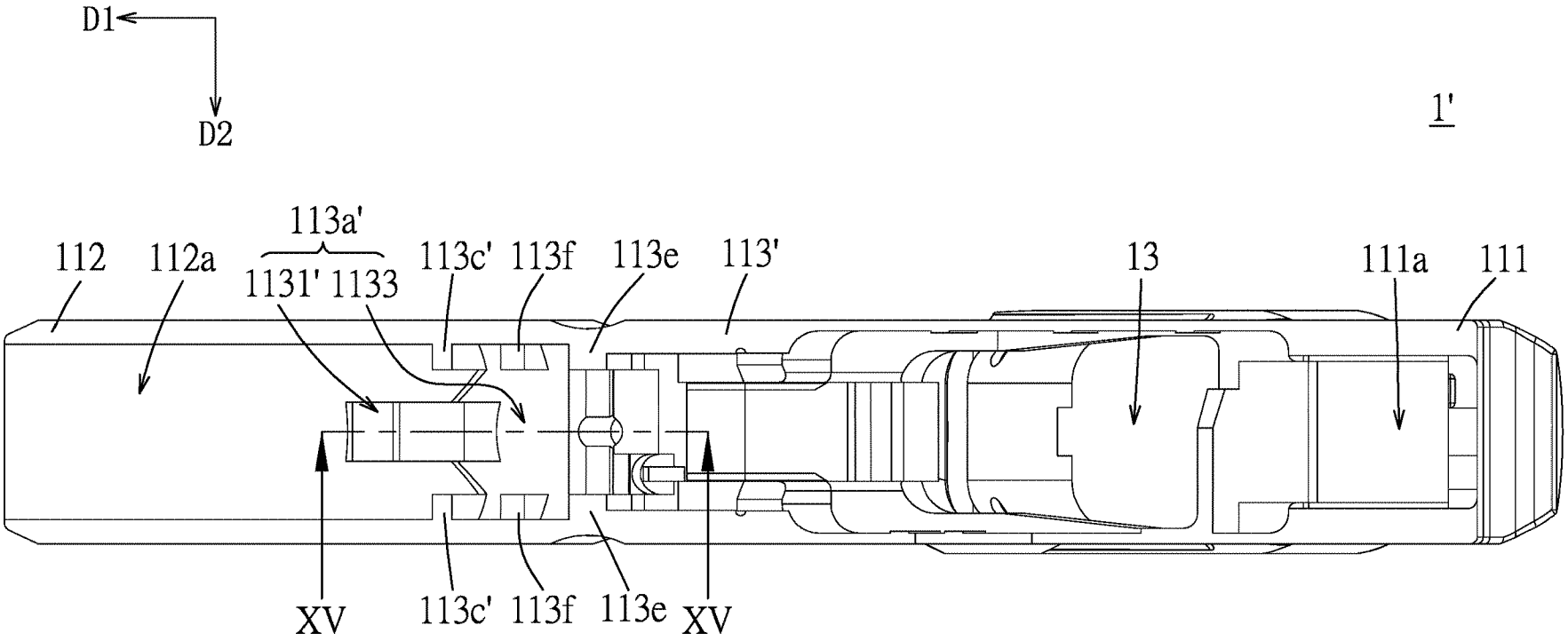
FIG. 14 is a schematic top view of the second embodiment but without the rear rail block and a locking block.

Referring to FIGS. 13 and 14, the second embodiment of the pistol frame 1' of this disclosure is shown to be generally identical to the first embodiment. However, in the second embodiment, the intermediate section 113' of the upper frame portion 11 includes the two rear stop portions (113*e*), two spaced-apart rib portions (113*f*) respectively proximate to and located forwardly of the rear stop portions (113*e*), and two spaced-apart front stop portions (113*c'*) located respectively and forwardly of the rib portions (113*f*) and spaced apart from the same. The mounting space (113*a'*) includes the front space portion 1131' located rearwardly of the front receiving space (112*a*) of the front section 112 and disposed lower than the front receiving space (112*a*), and a rear space portion 1133 defined by the rib portions (113*f*) and located rearwardly of the front space portion 1131'. A rear portion of the front space portion 1131' is located between the front stop portions (113*c'*).

Figure 15:
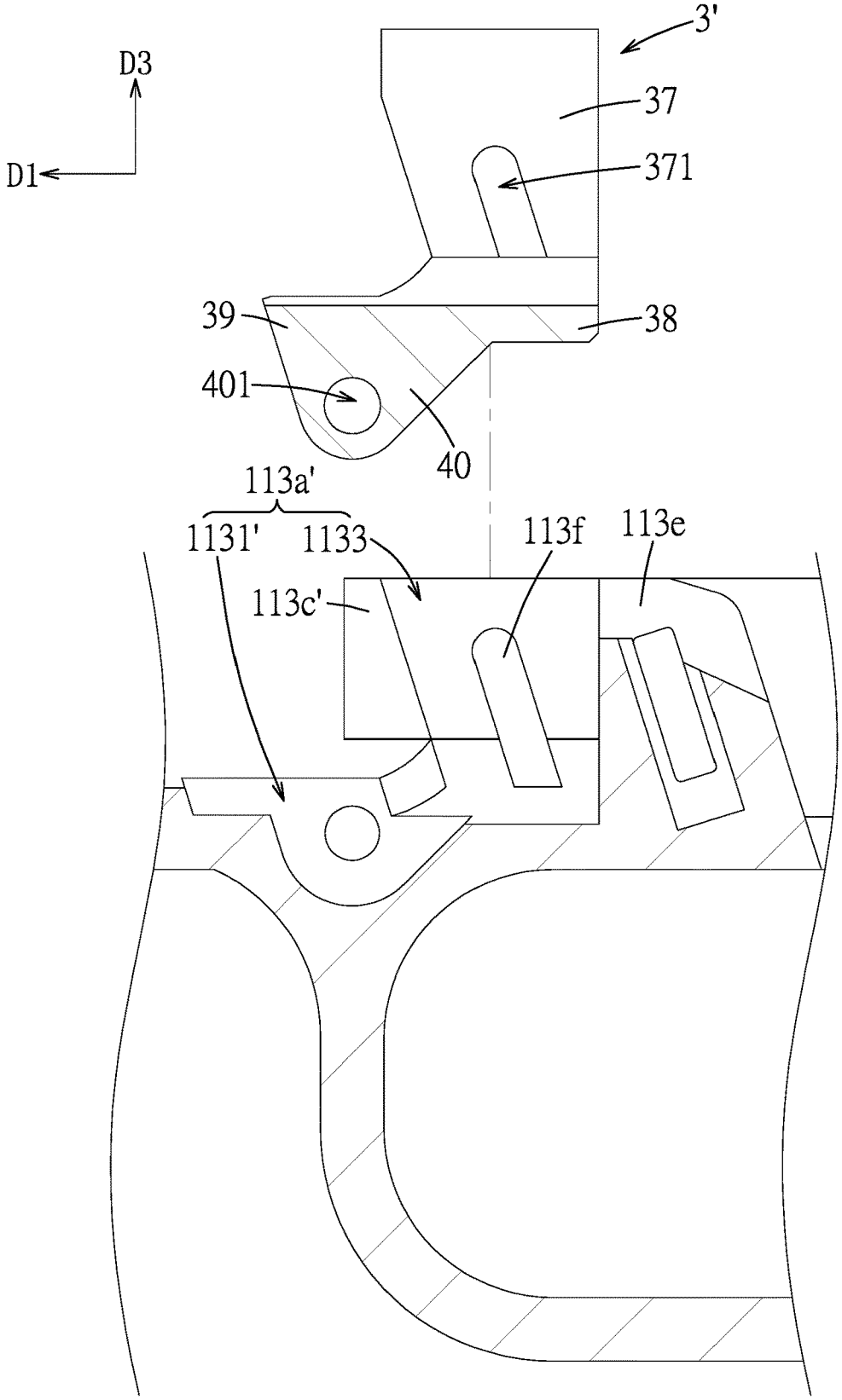
FIG. 15 is a sectional view taken along line XV-XV of FIG. 14, illustrating how the locking block can be disposed in a mounting space.

Referring to FIG. 15, in combination with FIGS. 13 and 14, the rear sides of the front stop portions (113*c'*) and the rib portions (113*f*) are inclined forwardly relative to the front-rear direction (D1).

Figure 16:
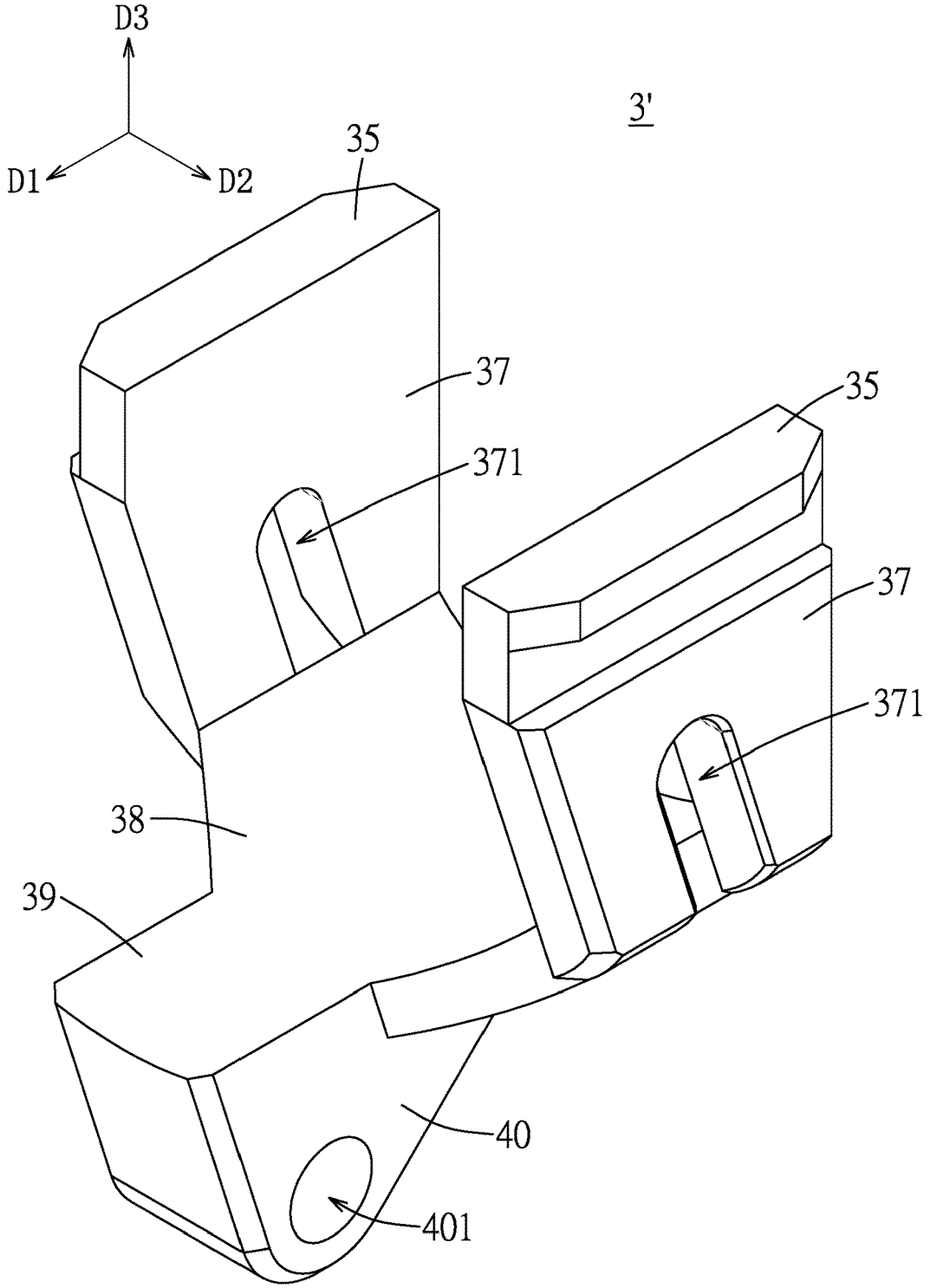
FIG. 16 is a perspective view of the locking block of the second embodiment.
Figure 17:
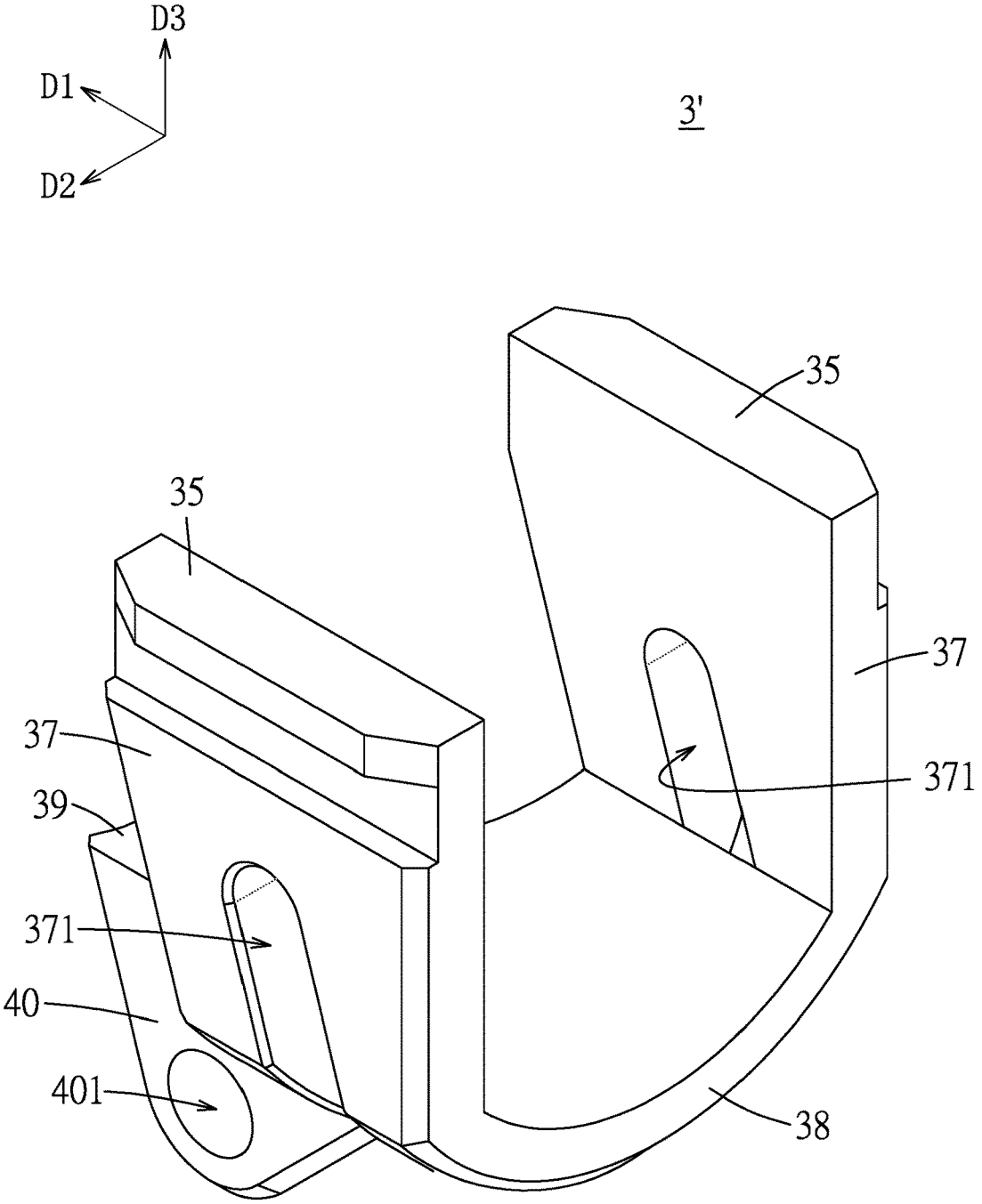
FIG. 17 is a view similar to FIG. 16, but taken from another angle.

Referring to FIGS. 16 and 17, in combination with FIG. 13, the locking block 3' of the second embodiment includes two spaced-apart engaging plates 37, a connecting plate 38 interconnecting inner bottom ends of the engaging plates 37, an extension portion 39 extending forwardly from a front end of the connecting plate 38, a protruding portion 40 extending downwardly from a bottom end of the extension portion 39, and two front rail portions 35 extending transversely, outwardly, oppositely and respectively from top ends of the engaging plates 37. Front sides of the engaging plates 37 are inclined forwardly relative to the front-rear direction (D1). Each engaging plate 37 has an engaging groove 371 extending inwardly, inclinedly and forwardly from an outer bottom end thereof. The engaging groove 371 of each engaging plate 37 has a shape matching that of a respective one of the rib portions (113*f*). The protruding portion 40 has a through hole 401 extending therethrough along the left-right direction (D2).

Referring again to FIG. 15, when the locking block 3' is disposed in the mounting space (113*a'*), the engaging plates 37 and the connecting plate 38 thereof are inclinedly inserted into the rear space portion 1133; the front sides of the engaging plates 37 respectively abut against the rear sides of the front stop portions (113*c'*), and the rear sides thereof respectively abut against the front sides of the rear stop portions (113*e*); the engaging groove 371 are respectively engaged to the rib portions (113*f*); the protruding portion 40 is inserted into the front space portion 1131'; and the through hole 401 is aligned with the second insertion holes 115 (see FIG. 2) of the upper frame portion 11 along the left-right direction (D2) for extension of the trigger housing pin 95 therethrough so as to fix the locking block 3' to the upper frame portion 11. It should be noted herein that, in this embodiment, the front sides of the engaging plates 37, the engaging groove 371 and the rib portions (113*f*) are designed to be inclined forwardly, so that when the locking block 3' is driven to move rearward and upward by the slide 94 (see FIGS. 1 and 2), the torque generated by the slide 94 to the locking block 3' cannot raise the locking block 3'. The effect of tightly fixing the locking block 3' in the mounting space (113*a'*) can be similarly achieved.

In sum, through the cooperation of the bottom plate 21 and the side plates 22 of the rear rail block 2 to define the receiving space 24, the trigger mechanism 93 of different generations of pistol may be disposed on the rear rail block 2, and the extensions 933 thereof may be received in the receiving space 24, so that the pistol frame 1, 1' of this disclosure can be universally used for the trigger mechanisms 93 of different generations of the pistols. Moreover, through the structure of the locking block 3, 3' and the inclined design of the mounting space (113*a*, 113*a'*), or by designing the rib portions (113*f*) to be inclined forwardly, the torque generated by the slide 94 to the locking block 3, 3' during firing of a bullet cannot raise the locking block 3, 3'. Therefore, the object of this disclosure can indeed be achieved.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A pistol frame made of plastic and suitable for mounting of a trigger mechanism, a slide, and a barrel thereto, the trigger mechanism including a trigger mechanism housing having two legs, two extensions extending downwardly and respectively from bottom front ends of the legs, and a through channel extending through the trigger mechanism housing in a left-right direction, said pistol frame comprising:

an upper frame portion extending along a front-rear direction transverse to the left-right direction and suitable for mounting of the slide and the barrel thereto, said upper frame portion including a rear section that defines a rear receiving space;

a handgrip portion connected to and extending downwardly from said upper frame portion; and a rear rail block disposed in said rear receiving space and suitable for receiving and supporting the trigger mechanism housing, said rear rail block including a bottom plate, two side plates extending upwardly and respectively from left and right ends of said bottom plate and configured to be located at two lateral sides of the trigger mechanism housing, each of said side plates having a through hole, said through holes in said side plates being configured to align with the through channel for extension of a trigger housing pin therethrough, thereby fixing said rear rail block and the trigger mechanism housing to said upper frame portion, and two rear rail portions extending transversely, outwardly, oppositely and respectively from top ends of said side plates for forward and rearward sliding movement of the slide thereon;

wherein said bottom plate and said side plates cooperatively define at least one receiving space suitable for receiving the extensions.

2. The pistol frame as claimed in claim 1, wherein said bottom plate has a rear side flush with rear sides of said side plates, and a front side located rearwardly of front sides of said side plates, said at least one receiving space being located in front of said bottom plate.

3. The pistol frame as claimed in claim 1, wherein the trigger mechanism housing further has a concave groove formed between the legs, said bottom plate having a raised section suitable for insertion into the concave groove and for supporting the trigger mechanism housing, said at least one receiving space including two receiving spaces each of which is located between one side of said raised section and a corresponding one of said side plates.

4. The pistol frame as claimed in claim 1, wherein said bottom plate has a front side flush with front sides of said side plates, and a rear side located rearwardly of rear sides of said side plates said rear rail block further including two spaced-apart bottom auxiliary plates respectively connected to inner bottom sides of said side plates and disposed slightly higher than said bottom plate, said bottom auxiliary plates having rear sides flush with rear sides of said side plates, and front sides opposite to said rear sides of said bottom auxiliary plates, and wherein said bottom plate and said side plates cooperatively define a receiving space located forwardly of said bottom auxiliary plates such that said front sides of said bottom auxiliary plates face said receiving space.

5. The pistol frame as claimed in claim 1, wherein said upper frame portion further includes an intermediate section located forwardly of said rear section and defining a mounting space, said mounting space including a front space portion, and two side space portions extending rearwardly and respectively from two opposite ends of said front space portion, said front space portion and said side space portions being inclined forwardly relative to the front-rear direction, said intermediate section including two shoulder portions respectively located at the back of said side space portions, and two rear stop portions respectively connected to and disposed higher than said shoulder portions, said pistol frame further comprising a locking block disposed in said mounting space, said locking block including a front insertion portion inserted into said front space portion, two side insertion portions extending rearwardly and respectively from two opposite ends of said front insertion portion and respectively inserted into said side space portions, two side connecting portions respectively connected to upper ends of said side insertion portions, two rear protruding portions protruding rearwardly and respectively from rear ends of said side connecting portions, and two front rail portions extending transversely, outwardly, oppositely and respectively from top ends of said side connecting portions, said rear protruding portions having bottom ends respectively abutting and pressing against said shoulder portions, and front ends respectively abutting against said rear stop portions.

6. The pistol frame as claimed in claim 1, wherein said said upper frame portion further includes an intermediate section located forwardly of said rear section and defining a mounting space, said mounting space including a front space portion, and a rear space portion located rearwardly of said front space portion, said intermediate section including two spaced-apart rear stop portions, two spaced-apart rib portions respectively proximate to and located forwardly of said rear stop portions and defining said rear space portion, said rib portions being inclined forwardly relative to the front-rear direction, said pistol frame further comprising a locking block disposed in said mounting space, said locking block including two spaced-apart engaging plates, a connecting plate interconnecting inner bottom ends of said engaging plates, an extension portion extending forwardly from a front end of said connecting plate, and a protruding portion extending downwardly from a bottom end of said extension portion, each of said engaging plates having an engaging groove for engagement with a respective one of said rib portions, said protruding portion being inserted into said front space portion.

* * * * *